US005295604A

United States Patent [19]

Van Ryswyk

[11] Patent Number: 5,295,604

[45] Date of Patent: Mar. 22, 1994

[54] TOGGLE LATCH

[76] Inventor: Henricus J. Van Ryswyk, 34 View Street, Annandale, New South Wales 2038, Australia

[21] Appl. No.: 961,922

[22] PCT Filed: Jul. 1, 1991

[86] PCT No.: PCT/AU91/00283

§ 371 Date: Jan. 4, 1993

§ 102(e) Date: Jan. 4, 1993

[87] PCT Pub. No.: WO92/00890

PCT Pub. Date: Jan. 23, 1992

[30] Foreign Application Priority Data

Jul. 13, 1990 [AU] Australia ..... PK1185

[51] Int. Cl.[5] ..... B65D 45/34

[52] U.S. Cl. ..... 220/321; 292/256.69; 24/272

[58] Field of Search ..... 220/321; 292/256.69; 24/272

[56] References Cited

U.S. PATENT DOCUMENTS

| | | | |
|---|---|---|---|
| 2,235,567 | 3/1941 | Sabatt et al. | 220/61 |
| 2,257,039 | 9/1941 | Dale | 220/61 |
| 2,304,911 | 12/1942 | Harpold | 24/68 |
| 2,579,975 | 12/1951 | Scott et al. | 220/61 |
| 3,637,257 | 1/1972 | Uncapher | 220/321 |
| 4,135,657 | 1/1979 | Benson et al. | 220/321 |
| 5,020,839 | 6/1991 | Kalb | 220/321 |

FOREIGN PATENT DOCUMENTS

| | | |
|---|---|---|
| 66468/86 | 6/1987 | Australia . |
| 54260/86 | 9/1987 | Australia . |
| 88227 | 9/1983 | European Pat. Off. . |
| 226552 | 6/1987 | European Pat. Off. . |
| 2221241 | 11/1973 | Fed. Rep. of Germany . |
| 2633255 | 12/1989 | France . |

*Primary Examiner*—Joseph Man-Fu Moy

*Attorney, Agent, or Firm*—Nies, Kurz, Bergert & Tamburro

[57] ABSTRACT

A toggle latch for releasably fastening and tensioning a closure band said latch comprising, a first member for connection to an end of said band, a second member for connection with the other end of said band, a lever hingedly connected adjacent a proximal end with said second member and a link member hingedly interconnecting said first member and said lever and being joined to said lever at a point spaced apart from said proximal end, said lever being movable between a first open position in which the extent of said lever diverges from said band and a second closed position in which said lever and link member nestably overlay said first and second members to draw said first member toward said second member.

13 Claims, 4 Drawing Sheets

TOGGLE LATCH

TECHNICAL FIELD

The present invention relates to latches and in particular to toggle latches used for fastening and tensioning a closure band.

The invention has been developed primarily for releasably fastening and tensioning a closure band used to clamp a lid to the peripheral rim of a storage drum and will be described hereinafter with reference to this use. However, it will be appreciated that the invention is not limited to this particular field.

BACKGROUND ART

In the past, conventional off-the shelf toggle latches have been riveted or spot welded to an appropriate channel-sectioned band and used to secure the lids to the rims of the storage drums.

One disadvantage of using these conventional toggle latches is that their design and method of construction results in the pivoting points of the latch being spaced away from the connecting points of the latch which causes them to be bulky and to protrude significantly beyond the peripheral edge of the band. Such protuberances can cause damage to the storage drums during transportation and in some cases complicate the handling procedures.

A further major disadvantage resulting from the pivoting points of the latch being offset from the band, is that it is through these pivots that the closing force acts. Accordingly, it is not possible to properly tension the band against the drum at the point the latch overlaps the closure band. This can result in leakage from the drum at this point.

Another disadvantage is that the conventional toggle latches available are generally very difficult to attach to the closure band as the devices need to be manipulated into part-opened positions for welding or riveting.

When drums of this nature are used for the transport of dangerous goods, Commonwealth regulations require that the latches be secured so they cannot open during transportation. With many of the latches currently in use, this is achieved by tying down the toggle lever with wire passed through various apertures provided in the latch. Not only is the effectiveness of such methods in doubt, it can be a difficult, time consuming and expensive operation.

A further disadvantage with the conventional band to overlap during tightening of the latch. This additional operation increases the overall manufacturing cost of the assembly.

It is an object of the present invention to provide a toggle latch which will avoid or at least ameliorate the above disadvantages of the prior art.

DISCLOSURE OF THE INVENTION

According to the invention there is provided a toggle latch for releasably fastening and tensioning a closure band said latch comprising, a first member for connection to an end of said band, a second member for connection with the other end of said band, a lever hingedly connected adjacent a proximal end with said second member and a link member hingedly interconnecting said first member and said lever and being joined to said lever at a point spaced apart from said proximal end, said lever being movable between a first open position in which the extent of said lever diverges from said band and a second closed position in which said lever and link member nestably overlay said first and second members to draw said first member toward said second member.

In a preferred embodiment the latch in the closed position has an arcuate profile corresponding to the curvature of a peripheral edge of a drum for which the closure is intended.

In this case the band is of a generally channel-shaped section for retaining a lid to the rim of the drum and said first and second members of the latch have a slightly larger corresponding section so that the latch nestably overlays and follows closely the contour of the band.

Preferably the latch members are hingedly connected by means of integrally formed inwardly directed flared projections on one connecting part, captively retained in tapered slots provided in the corresponding part.

In a preferred embodiment the toggle latch nestably overlays and does not protrude significantly beyond the peripheral edge of the band. Preferably the latch has an over-centre locking position and includes therein, two or more holes so positioned as to facilitate spot welding or riveting of the latch in the closed position directly onto the band.

In preference the first member of the latch slidably nests over the nearest end of the second member in the closed position thereby eliminating the need to provide a suitable joggle on the band.

BRIEF DESCRIPTION OF DRAWINGS

A preferred embodiment of the invention will now be described, by way of example only, with reference to the accompanying drawings in which.

BEST MODE FOR CARRYING OUT THE INVENTION

Figure 1:
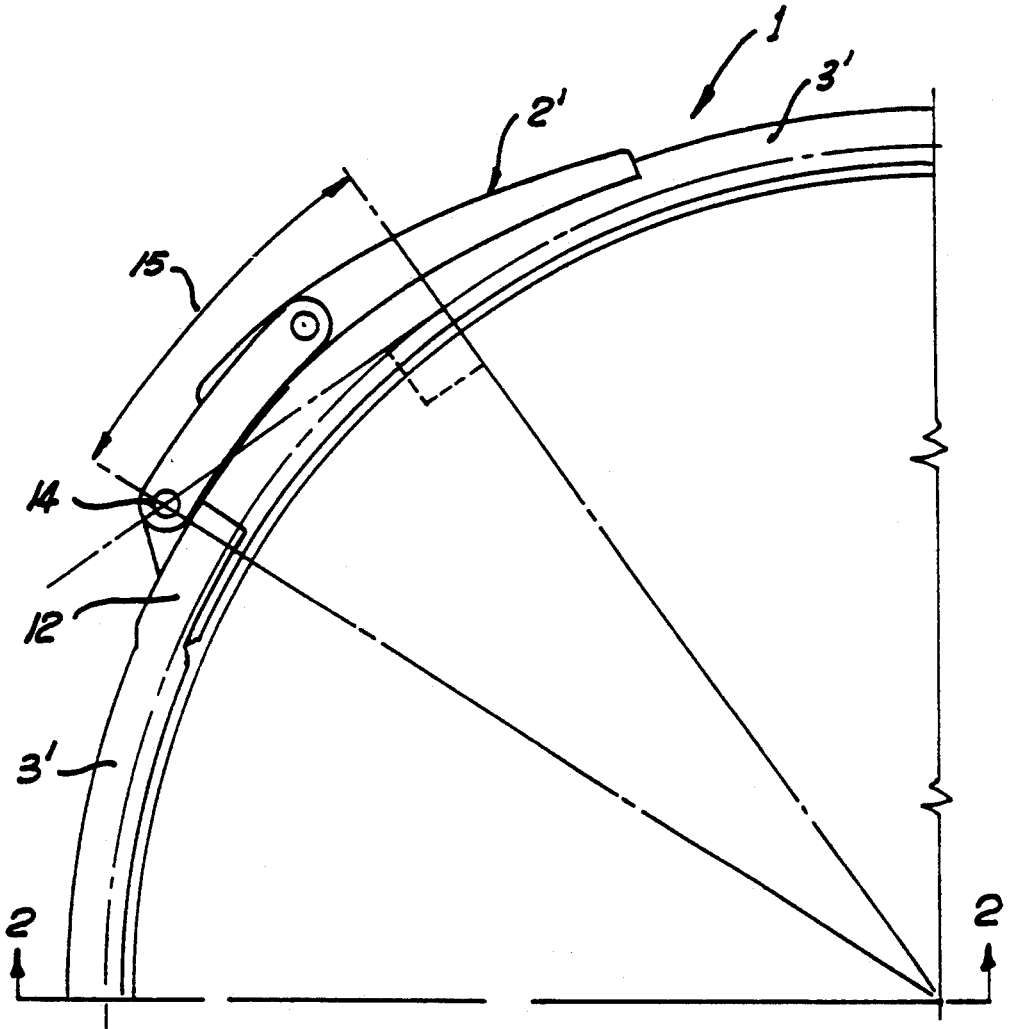
FIG. 1 is a schematic part plan view of a storage drum with prior art toggle latch and closure band.
Figure 2:
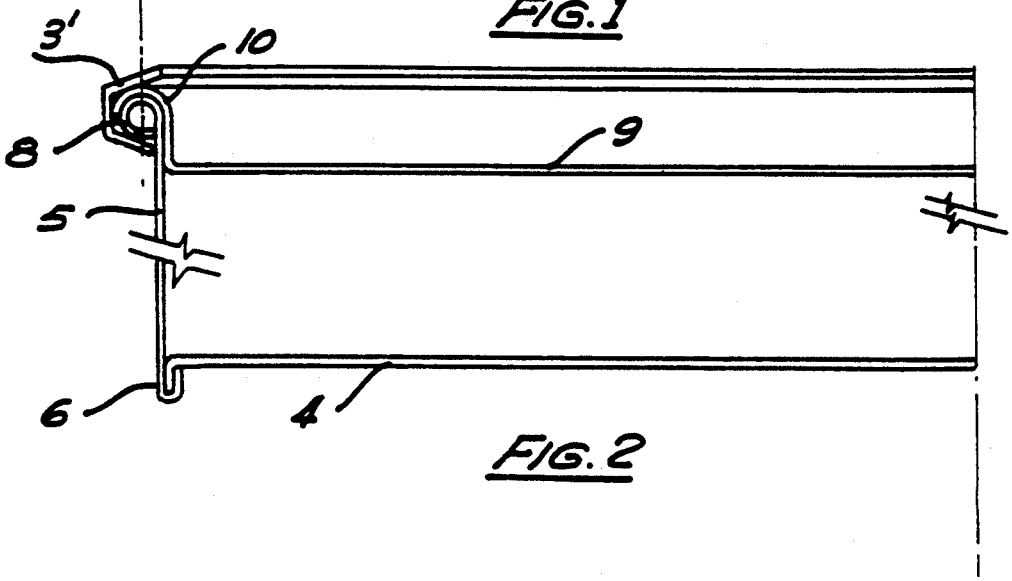
FIG. 2 is a schematic sectional part view of the prior art latch and drum assembly taken on line 2—2 of FIG. 1.
Figure 3:
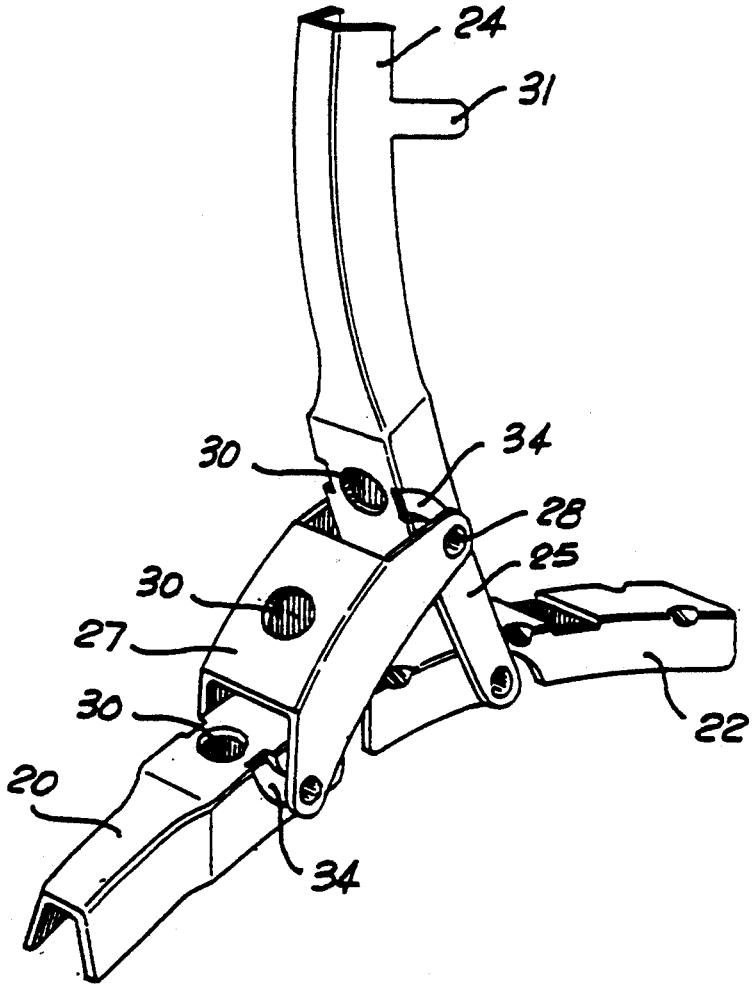
FIG. 3 is a schematic perspective view of a toggle latch according to the invention shown in the first open position.

Referring first to FIGS. 1 and 2 there is shown part of a storage drum 1 with prior art toggle latch 2' and closure band 3'.

The drum 1 in general includes a base 4 which is connected by rolling the lower edge of a substantially cylindrical side wall 5 to form a beaded edge 6. The upper edge of the wall 5 is rolled to form a scrolled rim 8.

The lid 9 is dished inwardly, terminating at its outer edge with a curled lip 10 that corresponds with the curvature of the drum rim 8. Sealing material is usually positioned between the lid 9 and the rim 8. The lid is then clamped to the drum by a toggle latch 2' secured to a closure band 3'. A joggle 12 is provided in the closure band to allow the ends of the band to overlap when the latch is closed.

It can be seen in FIG. 1 that the latch includes pivot points 14 through which the clamping force of the latch is directed which are positioned at a point spaced radially outwardly from the band. This is unavoidable as the pivots comprise rivets that pass through the latch across its full width. The resulting loss of clamping force can result in leakage in the area of low pressure 15 shown on the drawing.

The latch according to the invention will now be described with reference to FIGS. 3 to 9 of the drawings. Where appropriate like reference numerals will be used to denote corresponding features.

The latch 2 includes a first member 20 for connection to one end 21 of a closure band 3 and a second member 22 for connection with the other end 23. A lever 24 is hingedly connected adjacent a proximal end 25 with the second member 22. A link member 27 hingedly interconnects the first member 20 and the lever 24 and is joined to the lever at a point 28 spaced apart from the proximal end.

The lever 24 is movable from a first open position in which the lever diverges from the band 3 and a second closed position in which the lever 24 and link member 27 nestably overlay the first and second members 20 and 22 respectively.

As the lever 24 moves toward the closed position it draws the first member 20 toward the second member 22 thereby tensioning the band 3. As the construction of the latch 2 requires no axles at its pivoting points, in the closed position it follows closely the contour of the band and does not extend substantially beyond its peripheral edge.

Figure 4:
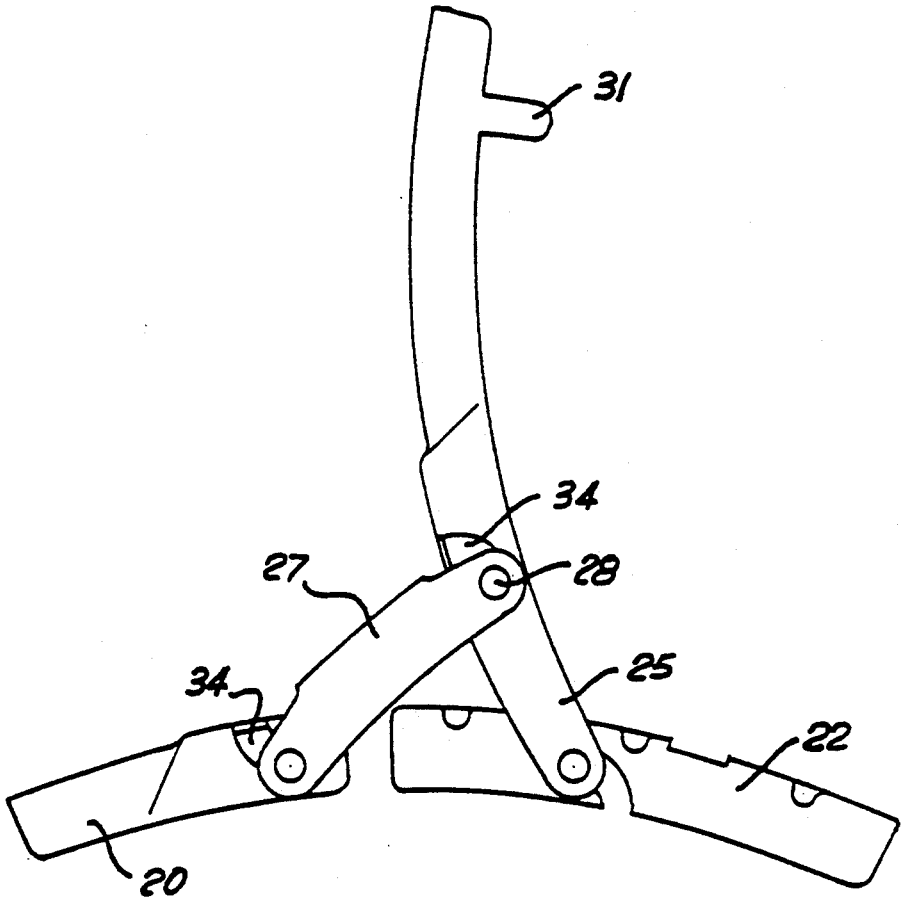
FIG. 4 is a side view of the latch shown in FIG. 3.
Figure 7:
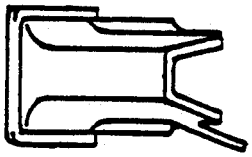
FIG. 7 is a right hand end view of the latch only shown in FIG. 6.
Figure 9:
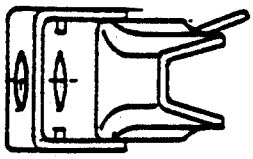
FIG. 9 is a left hand end view of the latch only shown in FIG. 6.

The preferred embodiment of the latch in the closed position has an arcuate profile as shown in FIG. 4, corresponding to the curvature of a peripheral rim of a drum for which it is intended. In such a case the closure band 3 is in the form of a substantially circumferential hoop of generally channel-shaped section.

Figure 5:
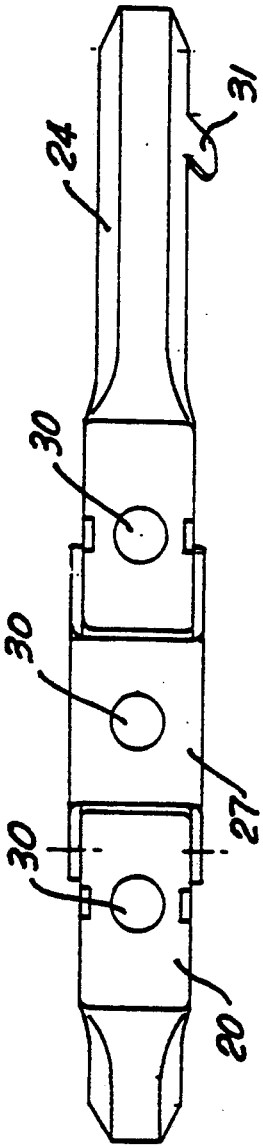
FIG. 5 is a plan view of the toggle latch and band shown in the closed position.
Figure 6:
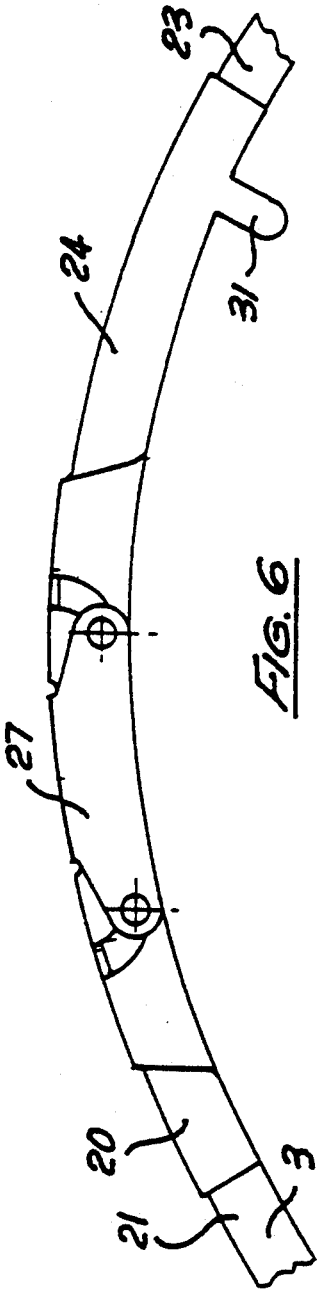
FIG. 6 is a side view of the latch and band shown in FIG. 5.
Figure 8:
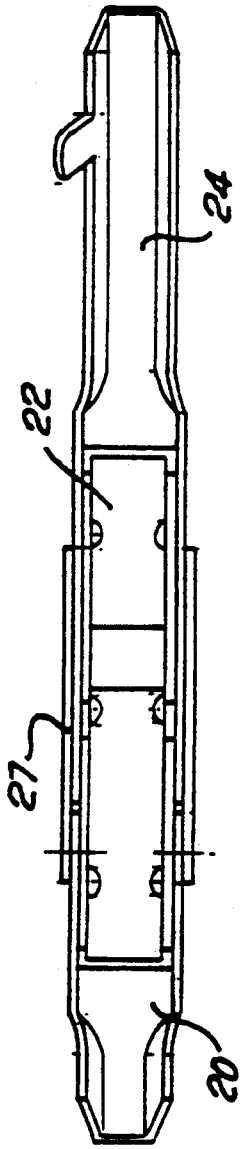
FIG. 8 is an inverted plan view of the latch shown in the closed position.

Referring in particular to FIG. 5 it can be seen that the latch has an over-centre locking position and that the latch 2 has in its outer surface a series of holes 30 which provide access for spot welding electrodes to the members below. A safety lug 31 is also provided on the lever 24.

In use, the latch would first be assembled to the closure hoop or band 3 which has been pre-formed and cut to define the appropriate size and curvature for the drum on which it is to be used.

In a suitable jig the latch in its closed position is overlayed the two abutting ends of the closure hoop. The hoop itself requires no overlap or joggle as the first member of the latch is designed to slidably nest within the second member. The latch 2 is then spot welded in the closed position onto the hoop 3 at the positions indicated by the holes 30 and on the upper surface 32 of the first member 20 thereby fastening the first and second members to the hoop.

This makes the welding operation extremely simple and accurate as the relevant position of the latch to the ring is not critical.

The assembled latch and hoop can then be opened and positioned around the peripheral edge of the drum as required such that the generally channel-shaped section of the hoop 3 encapsulates both the upper rim and lid of the drum (not shown).

Should it be necessary to prevent accidental release of the lever as would be required when transporting dangerous goods, the safety lug 31 can simply be pushed down 90 degrees over the rim of the drum thereby preventing operation of the lever 24.

The neat non-protruding profile of the latch is achieved by the axle-less pivots provided at the intersection of each of the connecting members.

The entire latch is manufactured from pressed sheet metal. In the preferred embodiment the projections forming the male pivot element provided on parts 24 and 27 are punch formed annular extrusions having a flared innermost flange. In this case the projections are produced in the blank prior to forming up the component. For each male pivot part corresponding arcuate slots 34 terminating in a home position 35 are provided in the corresponding connecting element. The slots 34 taper from an opening area which provides clearance on the innermost flanges of the projections and taper down to a point at which the projections are restrained in all but one direction.

In one embodiment, the slots 34 are shaped to define a constriction such that when the projections are forced past the constriction they are then held captive.

In this embodiment the parts can be assembled loosely and the action of the toggle used to pull the projection past the constriction into the home position. A positive step needs to be provided either for example by action of the first member 20 against the end of second member 22 or a stop lug 36 provided on second member 22. The lugs can be formed by the usual methods known to those skilled in this field, such as a cut and form or half-shear operation as appropriate.

A significant advantage of the latch made according to the invention is that the pivot points of the latch are at the sides of the latch only and in use they lie below the peripheral edge of the band. In this way the closing force is directed inside the rim of the drum thereby tensioning the band evenly along the edge of the drum. This clearly eliminates the low pressure problem area of the prior art previously discussed.

Whilst the preferred method of construction has been described above, alternate embodiments using standard riveting techniques come within the scope of the invention.

Although the invention has been described with reference to specific examples, it will be appreciated by those skilled in the art that the invention may be embodied in many other forms.

I claim:

1. A toggle latch for releasably fastening and tensioning a closure band said latch comprising, a first member for connection to an end of said band, a second member for connection with the other end of said band, a lever hingedly connected adjacent a proximal end with said second member and a link member hingedly interconnecting said first member and said lever and being joined to said lever at a point spaced apart from said proximal end, said lever being movable between a first open position in which the extent of said lever diverges from said band and a second closed position in which said lever and link member nestably overlay said first and second members to draw said first member toward said second member, said members being hingedly connected by means of integrally formed inwardly directed flared projections on one member, said flared projections being captively retained in slots formed in the corresponding member, said slots including constrictions to captively retain the projections between the respective constriction and closed end of each slot.

2. A toggle latch according to claim 1 wherein the latch in the closed position has an arcuate profile corresponding to the curvature of a peripheral rim of a drum for which the closure is intended.

3. A toggle latch according to claim 2 wherein the closure band is of a generally channel-shaped section for retaining a lid to the rim of the drum.

4. A toggle latch according to claim 3 wherein the interconnecting hinges have pivoted axes substantially coincident with a neutral axis of the closure band.

5. A toggle latch according to claim 3 wherein each slot is open adjacent either an internal or external edge of said closure band and terminates substantially adjacent a neutral axis of the closure band.

6. A toggle latch according to claim 5 wherein the slots taper toward the neutral axis.

7. A toggle latch according to claim 5 wherein slots are provided on said first member and said lever which are open adjacent an external edge of the closure band and a slot is provided on said second member which is open adjacent an internal edge of the closure band.

8. A toggle latch according to claim 1 wherein the constrictions are formed in the slots prior to assembling the latch members.

9. A toggle latch according to claim 8 wherein the projections are forced past the constriction by the toggle action of the latch during first closure of the latch under tension.

10. A toggle latch according to claim 3 wherein said first and second members of the latch have a slightly larger corresponding section and the channel-shape of the band so that the latch nestably overlays and follows closely the contour of the band.

11. A toggle latch according to claim 1 wherein the latch nestably overlays and does not protrude significantly beyond the peripheral edge of the band.

12. A toggle latch according to claim 11 wherein the latch has an over-centre locking position and includes therein two or more holes so positioned as to facilitate spot welding or riveting of the latch in the closed position directly onto the band.

13. A latch according to claim 1 wherein the first member of the latch slidably nests over the nearest end of the second member in the closed position, thereby eliminating the need to provide a suitable joggle on the band.

* * * * *